US006819227B2

(12) United States Patent
Arndt

(10) Patent No.: US 6,819,227 B2
(45) Date of Patent: Nov. 16, 2004

(54) ACOUSTIC SIGNAL GENERATOR, AND METHOD FOR GENERATING AN ACOUSTIC SIGNAL

(75) Inventor: Christian Arndt, München (DE)

(73) Assignee: Infineon Technologies AG, Munich (DE)

( * ) Notice: Subject to any disclaimer, the term of this patent is extended or adjusted under 35 U.S.C. 154(b) by 147 days.

(21) Appl. No.: 10/062,058

(22) Filed: Feb. 1, 2002

(65) Prior Publication Data

US 2002/0105414 A1 Aug. 8, 2002

(30) Foreign Application Priority Data

Feb. 1, 2001 (DE) ..... 101 04 590

(51) Int. Cl.[7] ..... G08B 3/00

(52) U.S. Cl. ..... 340/384.1; 340/384.4; 340/388.1; 340/388.3; 340/388.5

(58) Field of Search ..... 340/384.4, 388.1, 340/388.3, 388.5, 311.1, 407.1, 384.1; 381/96, 58, 59

(56) References Cited

U.S. PATENT DOCUMENTS 4,149,153 A * 4/1979 Shigemori et al. ..... 340/384 E
6,188,313 B1 * 2/2001 Stahn ..... 340/384.73
6,380,847 B1 * 4/2002 Bremond et al. ..... 340/388.3

FOREIGN PATENT DOCUMENTS

DE 42 18 621 C2 12/1992
EP 0 884 719 A1 12/1998

* cited by examiner

*Primary Examiner*—Jeffery Hofsass
*Assistant Examiner*—Hung Nguyen
(74) *Attorney, Agent, or Firm*—Laurence A. Greenberg; Werner H. Stemer; Ralph E. Locher

(57) ABSTRACT

An acoustic signal generator, and a method for generating an acoustic signal are described. The acoustic signal generator has a membrane that can oscillate, a deflection sensor for detecting any deflection of the membrane, an exciter configuration that is coupled to the membrane, and a power semiconductor switch with a load path that is connected to the exciter configuration. The switch has a drive connection. A drive circuit has a first connection connected to the drive connection of the power semiconductor switch and at which a drive signal is available. The drive circuit further has a second connection, to which the deflection sensor is connected.

18 Claims, 6 Drawing Sheets

ACOUSTIC SIGNAL GENERATOR, AND METHOD FOR GENERATING AN ACOUSTIC SIGNAL

BACKGROUND OF THE INVENTION

Field of the Invention

The present invention relates to an acoustic signal generator, in particular a horn, and to a method for generating an acoustic signal. The acoustic signal generator has a membrane that can oscillate, a deflection sensor for detecting any deflection of the membrane, and an exciter configuration coupled to the membrane.

Acoustic signal generators of this generic type have a membrane that can oscillate, is normally composed of metal, and is coupled to the exciter configuration. The exciter configuration normally has an exciter coil and an armature that is inductively coupled to the exciter coil and is connected to the membrane. In known appliances, a mechanical switch is provided for applying a supply voltage to the exciter winding, with the armature together with the membrane being deflected when the switch is closed, and current thus flows through the coil, and with the membrane together with the armature moving back again in the direction of its original position when the switch is subsequently opened, and overshooting beyond the original position. The mechanical switch is coupled to the membrane and is opened again when the membrane has reached a specific deflection when the switch is closed, the deflection being dependent on the configuration of the mechanical switch on the membrane. The mechanical switch is opened and closed in a clocked manner in this way, with the clock frequency being dependent on the natural frequency of the oscillating system that contains the membrane and armature. The membrane in consequence oscillates at its natural frequency, which is in the human audibility range in the case of horns.

The volume can be adjusted by the configuration of the mechanical switch on the membrane, with the tone which is generated being quieter when the switch is switched off again while the membrane deflection is still small, and with the tone which is generated being louder when the mechanical switch is not switched off again until the membrane deflection is greater.

A configuration such as this has the disadvantage that spark emissions can occur at the mechanical switch when the exciter winding is disconnected from the supply voltage and, in some circumstances, this results in severe electromagnetic radiated interference emission.

Furthermore, a considerable power loss occurs in an uncontrolled manner in the switch, which is driven in a clocked manner at the natural frequency of the oscillating system containing the membrane and armature, which is normally several hundred Hertz, and this can considerably reduce the life of known horns.

SUMMARY OF THE INVENTION

It is accordingly an object of the invention to provide an acoustic signal generator, and a method for generating an acoustic signal which overcomes the above-mentioned disadvantages of the prior art devices and methods of this general type.

With the foregoing and other objects in view there is provided, in accordance with the invention, an acoustic signal generator. The signal generator has a membrane which can oscillate, a deflection sensor for detecting any deflection of the membrane, an exciter configuration coupled to the membrane, a power semiconductor switch having a load path connected to the exciter configuration and a drive connection, and a drive circuit having a first connection connected to the drive connection of the power semiconductor switch and generating a drive signal available at the drive connection. The drive circuit has a second connection connected to the deflection sensor.

Accordingly, the acoustic signal generator according to the invention has, in addition to the membrane which can oscillate, the deflection sensor, and the exciter configuration which is coupled to the membrane, a power semiconductor switch and a drive circuit which is connected to a drive connection of the power semiconductor switch and to which the deflection sensor is connected.

The exciter configuration preferably contains an exciter winding and an armature which is inductively coupled to the exciter winding, with the exciter winding being connected to a supply voltage in series with a load path of the power semiconductor switch. The use of a power semiconductor switch, in particular of a power MOSFET has the advantage over the use of a mechanical switch for switching the exciter winding that the electromagnetic interference emissions that occur during switching are considerably reduced.

The semiconductor switch that is used is preferably a temperature-protected semiconductor switch that is marketed, for example, by Infineon Technologies AG, Munich, under the designation TEMPFET. Ideally, the semiconductor switch has, in addition to temperature protection, integrated overvoltage protection and/or integrated short-circuit protection, and semiconductor switches such as these are marketed by Infineon Technologies AG, Munich, under the designation HITFET. Temperature-protected semiconductor switches protect themselves and switch themselves off when their temperature exceeds a predetermined value owing to the power losses that occur. The temperature-protected semiconductor switch is preferably thermally coupled to the housing in which the exciter configuration is accommodated. In this way, the semiconductor switch also monitors the temperature in the vicinity of the exciter configuration and switches itself off, and cannot be switched on, when the temperature is above a predetermined value. This measure contributes to increasing the life of the signal generator since this prevents the exciter coil from being overheated.

The switch-on resistance of the semiconductor switch is preferably selected such that a not inconsiderable proportion of the total power loss that occurs is incurred in the semiconductor switch. The power loss in the exciter winding is reduced by this measure, which likewise contributes to increasing the life of the signal generator.

The deflection sensor, which is connected to the drive circuit, is preferably a capacitive sensor that has at least one capacitor, whose capacitance varies as a function of the deflection of the membrane. The capacitance of this at least one capacitor is evaluated in the drive circuit, with the power semiconductor switch always being opened when the capacitance is greater than or less than a predetermined value. Various known evaluation circuits may be used to determine the capacitance of the variable capacitor. For example, one embodiment of the invention provides for the capacitor to be connected in series with a current source and for the current from the power source to be applied to the capacitor for a predetermined time period, and for the voltage that is present across the capacitor to be measured at the end of this time period. In this case, use is made of the fact that the voltage that is produced on the capacitor by the charge flowing into it is proportional to its capacitance, given that the charging current and the charging time are the same.

A further embodiment provides for the capacitor to be charged to a predetermined voltage, and for the change in the voltage across the capacitor to be observed. The charge that is stored in the capacitor in this case remains constant, so that the voltage across the capacitor rises when its capacitance decreases, and vice versa.

A further embodiment provides for the capacitor to be connected in a first series resonant circuit of a bridge circuit, with the bridge circuit having a second series resonant circuit in parallel with the first series resonant circuit, and with the two series resonant circuits being excited by an AC voltage. The frequency of the first series resonant voltage in this case varies with the value of the capacitance of the capacitor in the capacitive sensor. The two series resonant circuits each have a tapping point for tapping off a potential in the respective series resonant circuit, with the tapping points being connected to an evaluation circuit which uses the difference between these two potentials to produce a drive signal, which is dependent on the value of the capacitance of the variable capacitor, for the semiconductor switch. The drive circuit evaluates, in particular, the zero crossing of the difference voltage, with the components in the bridge circuit being matched to one another such that, at the zero crossing of the difference signal, the variable capacitor has a capacitance which results in the membrane reaching that deflection at which the switch is intended to be switched off. The bridge circuit is used to trim the capacitance of the variable capacitor to a nominal value, which is dependent on the other components in the bridge circuit.

In order to provide the capacitive sensor, a first embodiment of the invention provides for a first capacitor plate of the at least one capacitor in the capacitive sensor to be formed by the membrane itself. A further embodiment provides for the first capacitor plate to be formed by a first electrode, which is mechanically coupled to the membrane or to the armature. The first electrode is in this case deflected in the same way as the membrane.

A second capacitor plate of the at least one capacitor in the capacitive sensor is, according to one embodiment of the invention, formed by a housing which surrounds the membrane and, possibly, the exciter configuration and is electrically insulated from the membrane. A further embodiment provides for the second capacitor plate to be formed by a second electrode, which is disposed such that it is at a distance from the membrane and is insulated from the housing. The second capacitor plate can also be formed by a housing cover disposed above the membrane.

The membrane or the first electrode, which forms the first capacitor plate, and the housing, the second electrode or the cover, which forms the second capacitor plate, have suitable connections for connection to the drive circuit.

In exemplary embodiments in which the membrane is not composed of metal, the invention provides for metal to be vapor-deposited onto a portion of the membrane, in order to form the first capacitor plate.

In accordance with an added feature of the invention, the drive circuit has a third connection for receiving a switch-on signal.

In accordance with another feature of the invention, the drive signal is dependent on a capacitance of the capacitor of the capacitive sensor.

In accordance with a further feature of the invention, the drive circuit has a current source, a drive circuit switch connected in parallel with the capacitor, and a comparator circuit connected to the capacitor for evaluating a capacitance of the capacitor. The current source is connected in series with the capacitor. The comparator circuit compares a voltage across the capacitor with a reference voltage, and, the comparator circuit has an output providing an output signal that is dependent on a comparison.

In accordance with an additional feature of the invention, the drive signal is dependent on the output signal at the output of the comparator circuit, and on the switch-on signal.

In accordance with another further feature of the invention, the drive circuit has a diode connected in series with the capacitor, a drive circuit switch connected in parallel with the capacitor, and a comparator configuration connected to the capacitor.

With the foregoing and other objects in view there is provided, in accordance with the invention, a method for generating an acoustic signal in dependence on a switch-on signal. The method includes providing a membrane which can oscillate, an exciter configuration coupled to the membrane, a drive circuit receiving the switch-on signal, a power semiconductor switch connected to the drive circuit, and a deflection sensor for detecting any deflection of the membrane. An opening and closing of the power semiconductor switch is clocked for as long as the switch-on signal is at a given value, with a closing duration, during which the power semiconductor switch is closed during a clock period, being dependent on the deflection sensor.

In accordance with an added mode of the invention, there is the step of forming the deflection sensor as a capacitive sensor having at least one variable capacitor, and in which the closing duration is dependent on a capacitance of the variable capacitor.

In accordance with another mode of the invention, there is the step of determining a value of the capacitance of the variable capacitor when the power semiconductor switch is opened and after the switch-on signal has assumed the given value, and the value of the capacitance of the variable capacitor is taken into account when determining the closing duration of the power semiconductor switch.

In accordance with a concomitant feature of the invention, there is the step of opening the power semiconductor switch again after being closed, when the capacitance of the variable capacitor has changed by a predetermined percentage value.

Other features which are considered as characteristic for the invention are set forth in the appended claims.

Although the invention is illustrated and described herein as embodied in an acoustic signal generator, and a method for generating an acoustic signal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
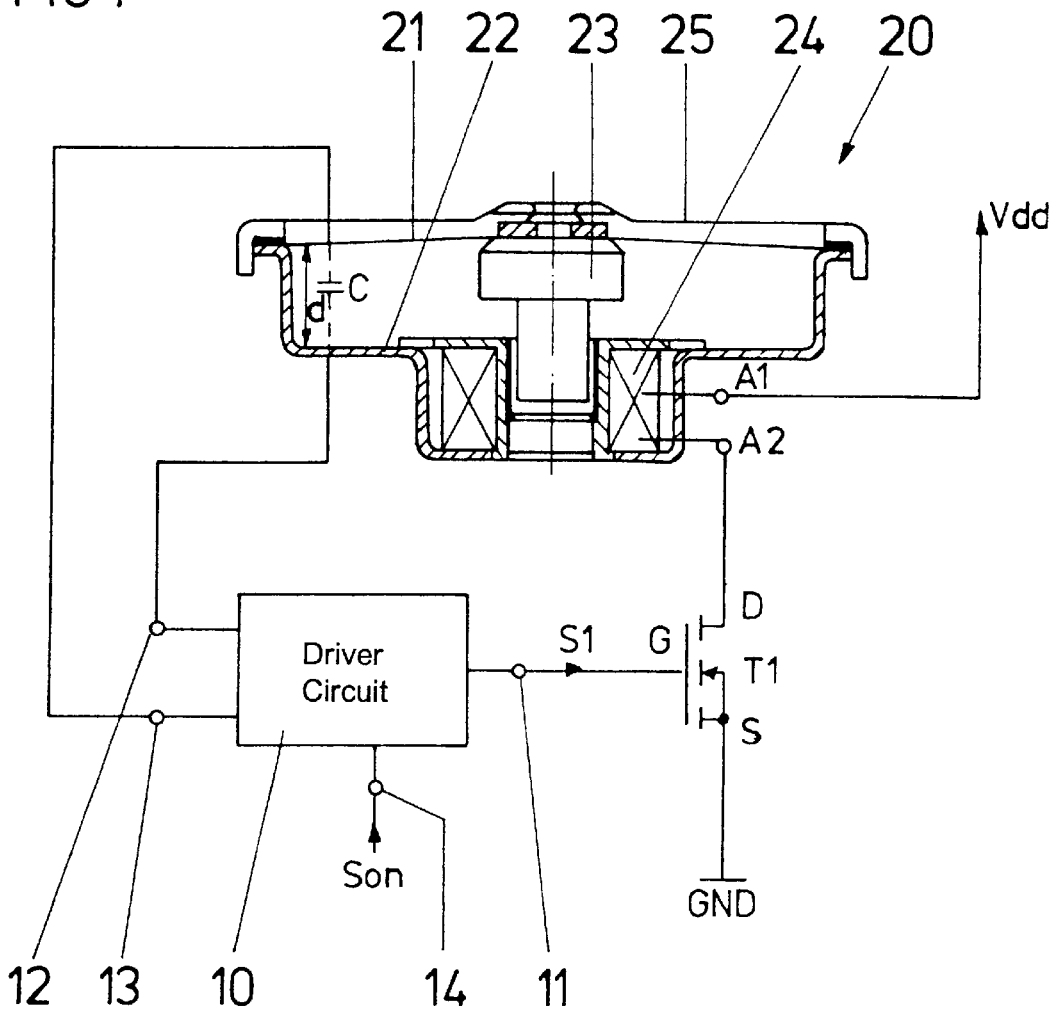
FIG. 1 is a diagrammatic, sectional view of an acoustic signal generator having a membrane that can oscillate, a semiconductor switch, a drive circuit and a capacitive deflection sensor according to the invention.

In all the figures of the drawing, sub-features and integral parts that correspond to one another bear the same reference symbol in each case. Referring now to the figures of the drawings in detail and first, particularly, to FIG. 1 thereof, there is shown an exemplary embodiment of an acoustic signal generator according to the invention. The signal generator has a signal transmitter 20 with a membrane 21 which can oscillate and is disposed in a housing 22. In the exemplary embodiment, the membrane 21 is firmly connected to an armature 23, which is in turn inductively coupled to an exciter winding 24, with the exciter winding 24 having an annular shape, and with the armature 23 being located in an existing opening in the annular exciter winding 24. In the exemplary embodiment shown in FIG. 1, the housing 22 together with the membrane 21 is covered by a cover 25, which is electrically insulted from the membrane 21. The housing 22 in the exemplary embodiment is also electrically insulated from the membrane 21. The exciter winding 24 has connecting terminals A1, A2, which are illustrated only schematically.

A power semiconductor switch T1 is provided for connecting the exciter winding 24 to a supply voltage and, in the exemplary embodiment, is in the form of a power MOSFET T1, whose drain-source path D-S is connected in series with the exciter winding 24. The series circuit contains the exciter winding 24 and the MOSFET T1 is connected to terminals for a first supply potential Vdd and a second supply potential GND, so that a current flows through the exciter winding 24 when the MOSFET T1 is switched on. A drive circuit 10 is provided for driving the MOSFET T1 and has a first connection 11, which is connected to a gate connection G of the MOSFET T1, and at which a drive signal S1 is available.

A deflection sensor is connected to connections 12, 13 of the drive circuit 10. In the exemplary embodiment shown in FIG. 1, the deflection sensor is in the form of a capacitive sensor, which has a capacitor. One capacitor plate of the capacitor is in this case formed by the metallic membrane 21 to which the connection 13 of the drive circuit 12 is connected. A second capacitor plate of the capacitor is formed by the housing 22 of the signal transmitter 20, to which the connection 12 of the drive circuit 10 is connected. To assist understanding, the electrical symbol of a capacitor C is shown between the membrane 21 and the housing 22 in FIG. 1. The capacitance of the capacitor C varies with the distance between the membrane 21 and the housing 22. Connections of the two capacitor plates of the capacitor in the capacitive sensor are illustrated only schematically in FIG. 1.

When a current flows through the exciter winding 24 with the MOSFET T1 switched on, then the armature 23 is moved downward by the magnetic field induced in the exciter winding 24, and the membrane 21 is deflected downward, thus reducing the distance between the membrane 21 and the housing 22. This results in an increase in the capacitance value of the capacitor C formed between the membrane 21 and the housing 22. The drive circuit 10 is configured to drive the MOSFET T1 as a function of a value of the capacitance of the capacitor C, with the MOSFET T1 being switched off in the present case when the capacitance of the capacitor C is greater than a predetermined value. The value of the capacitance of the capacitor C represents a measure of the deflection of the membrane 21 from its original state. If, after being deflected, the membrane 21 moves back in the direction of its original position again and, in consequence, the value of the capacitance of the capacitor C falls, then the MOSFET T1 is switched on again, in order to deflect the armature 23, together with the member 21, once again.

When driven in such a way, the membrane 21 oscillates at its natural frequency, which is governed by the physical characteristics of the membrane 21 and of the armature 23 that is coupled to the membrane 21. In the case of horns, the natural frequency is in the human audibility range, and is preferably a few hundred hertz.

Figure 2:
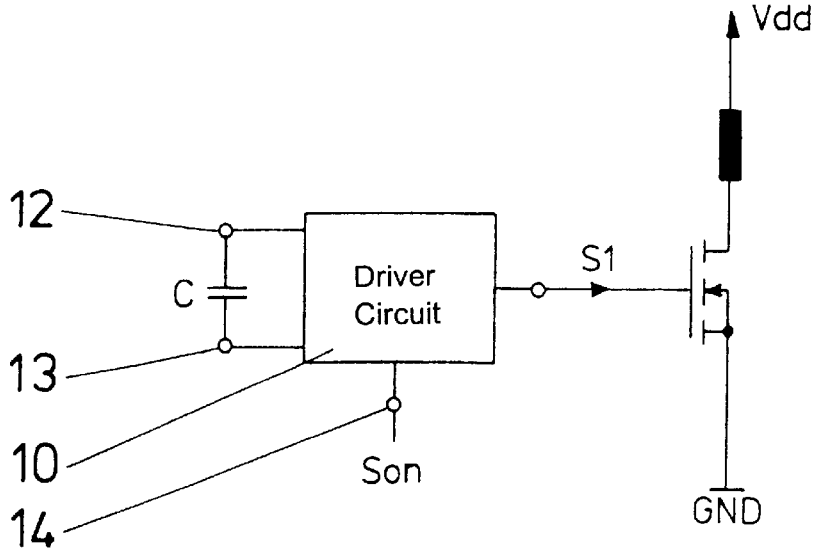
FIG. 2 is an electrical equivalent circuit of the configuration shown in FIG. 1.

FIG. 2 shows an electrical equivalent circuit of the configuration shown in FIG. 1, in which the exciter winding 24 is illustrated as an inductance connected in series with the MOSFET T1, and in which the capacitive sensor is illustrated as the capacitor C between the connections 12, 13 of the drive circuit 10.

The drive circuit 10 has a further connection 14 for supplying a switch-on signal Son. The signal Son determines whether an acoustic signal will be produced by the signal transmitter 20, that is to say whether the MOSFET T1 will be driven in a clocked manner as a function of the capacitance of the capacitor C, in order to cause the membrane 21 to oscillate, via the exciter winding 24 and the armature 23.

Figure 3:
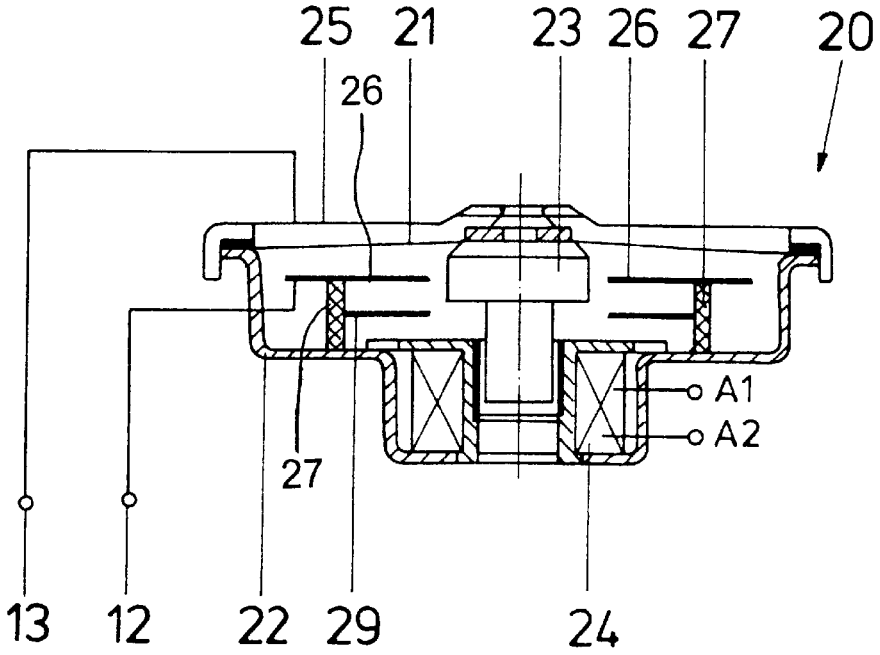
FIG. 3 is a sectional view of the acoustic signal generator having the deflection sensor according to a second embodiment of the invention.

FIG. 3 shows a further exemplary embodiment of the signal transmitter 20 with a built-in capacitive deflection sensor that can be connected to the connecting terminals 12, 13 of the drive circuit 10. A first capacitor plate of the capacitor in the capacitive sensor is formed by the membrane 21, which can oscillate, as in the exemplary embodiment shown in FIG. 1. In order to form a second capacitor plate, a first electrode 26 is provided in the exemplary embodiment shown in FIG. 3, is disposed at a distance from the membrane 21, and rests on a holder 27 that is supported against the housing 22. The holder 27 is preferably formed from an electrically insulating material. The first electrode 26 rests rigidly in the housing 22, and the capacitance of the capacitor formed from the membrane 21 and the first electrode 26 is governed by the distance between the membrane 21 and the first electrode 26. The capacitance varies with the deflection of the membrane 21. As in the exemplary embodiment shown in FIG. 1, the membrane 21 is connected to the connection 13 of the drive circuit 10. In the exemplary embodiment shown in FIG. 3, the first electrode 26 is connected to the connection 12 of the drive circuit 10, with the connections to the capacitor plates likewise being illustrated only schematically in this case.

Figure 4:
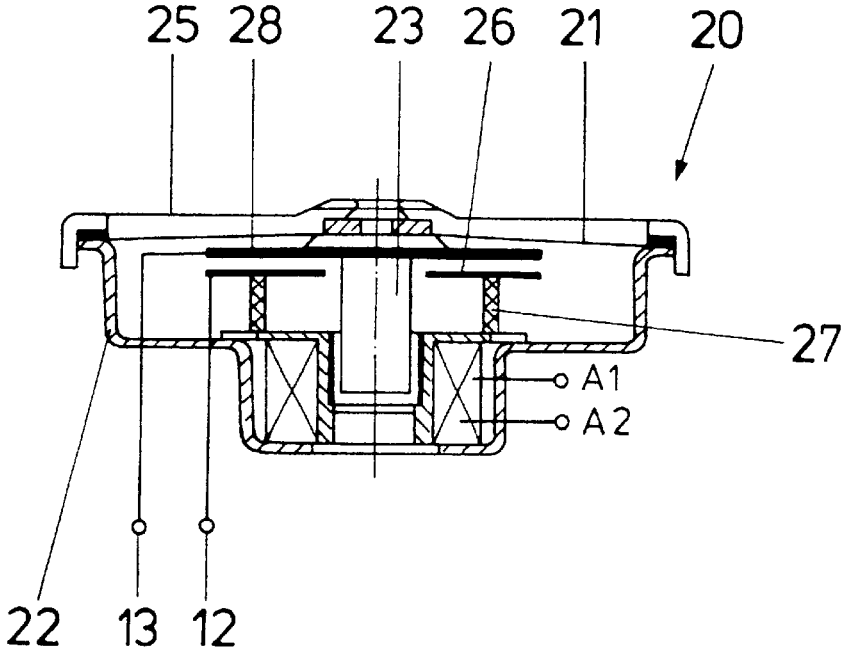
FIG. 4 is a sectional view of the acoustic signal generator having the deflection sensor according to a third embodiment of the invention.

FIG. 4 shows a further exemplary embodiment of the signal transmitter 20 with the integrated capacitive deflection sensor, with, in this exemplary embodiment, the second capacitor plate of the capacitor in the capacitive sensor being formed by the first electrode 26, which rests rigidly on a holder 27 in the housing 22. The first capacitor plate of the capacitor in the capacitive sensor is formed, in the exemplary embodiment shown in FIG. 4, by a second electrode 28, which is firmly connected to the armature 23 and is disposed at a distance from the first electrode 26 when the armature 23 is in its rest position. When the armature 23 is deflected downward by current flowing through the exciter winding 24, then the distance between the first electrode 26 and the second electrode 28 is reduced, so that the capacitance of the capacitor formed by the two electrodes 26, 28 is increased. In the exemplary embodiment, the first electrode 26 is connected to the connection 12 of the drive circuit 10, and the second electrode 28 is connected to the connection 13 of the drive circuit 10. The firm connection of the second electrode 28 to the armature 23 results in the first electrode 28 being coupled to the membrane 21, that is to say the distance between the first electrode 26 and the second electrode 28 is reduced when the membrane 21 is deflected downward when current flows through the exciter winding 24, and the distance increases again when the membrane 21 subsequently moves back to its original position again, when the semiconductor switch T1 is switched off.

Figure 5:
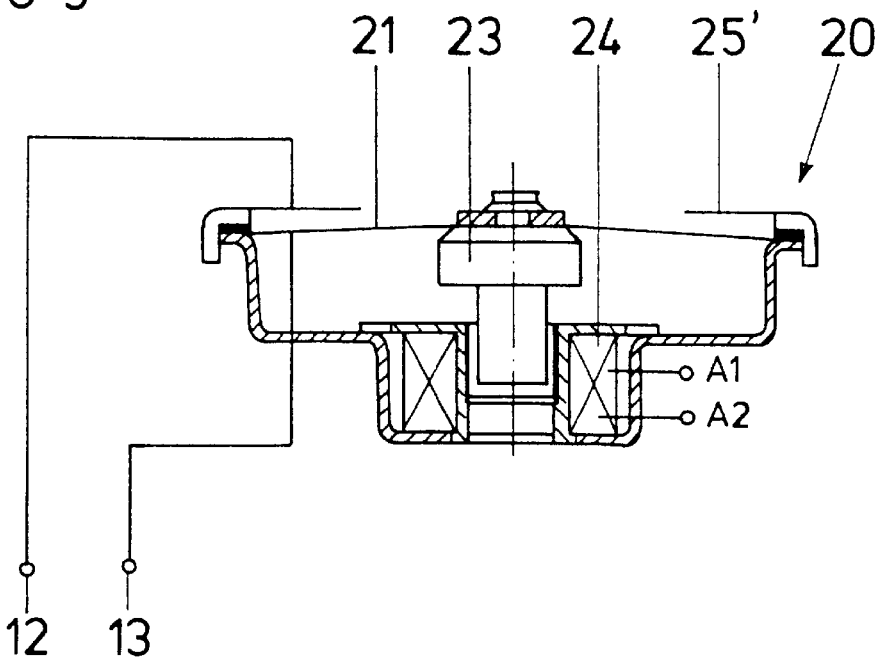
FIG. 5 is a sectional view of the acoustic signal generator having the deflection sensor according to a fourth embodiment.

FIG. 5 shows a further exemplary embodiment of the signal transmitter 20 according to the invention with an integrated capacitive deflection sensor, in which the first capacitor plate of the capacitor of the deflection sensor is formed by the membrane 21, and in which a second capacitor plate of the capacitor of the deflection sensor is formed by a cover 25', which is configured to be insulated from the membrane 21 and has an opening in the center. The open cover 25' is in this case connected to the connection 12 of the drive circuit 10, and the membrane 21 is connected to the connection 13 of the drive circuit 10.

The exemplary embodiments shown in FIGS. 1, 3, 4 and 5 have the common feature that the capacitance of the capacitor C which is a component of the capacitive sensor integrated in the housing 22 of the signal transmitter 20 increases as the deflection of the membrane 21 from its original position increases. In the following figures, in which exemplary embodiments of the drive circuit 10 for driving the power transistor T1 are described, the capacitive deflection sensor is illustrated as the variable capacitor C, independent of its actual implementation in the signal transmitter 20.

A temperature-protective power transistor is preferably used as the power transistor T1 for connecting the exciter winding 24 to the supply voltage between Vdd and GND in the signal generator according to the invention, and the power transistor T1 switches off and/or prevents switching on when the temperature of the semiconductor body/chip in which it is integrated is greater than a predetermined value. The semiconductor body/chip in which the power transistor T1 is integrated preferably has a good thermal coupling to the housing 22, preferably in the region of the exciter winding 24. In addition to its own temperature, the power transistor T1 in the embodiment also monitors the temperature in the signal transmitter 20. If the chip of the power transistor T1 is heated by the exciter winding 24 in the housing 22 to such an extent that the switch-off temperature is reached, then the power transistor T1 switches off, and it is prevented from switching on again until the temperature has dropped once is again. This measure, namely the configuration of a temperature-protected power transistor T1 on the housing 22, prevents the exciter winding 24 from being overheated, and thus contributes to increasing the life of the signal transmitter 20.

Figure 6:
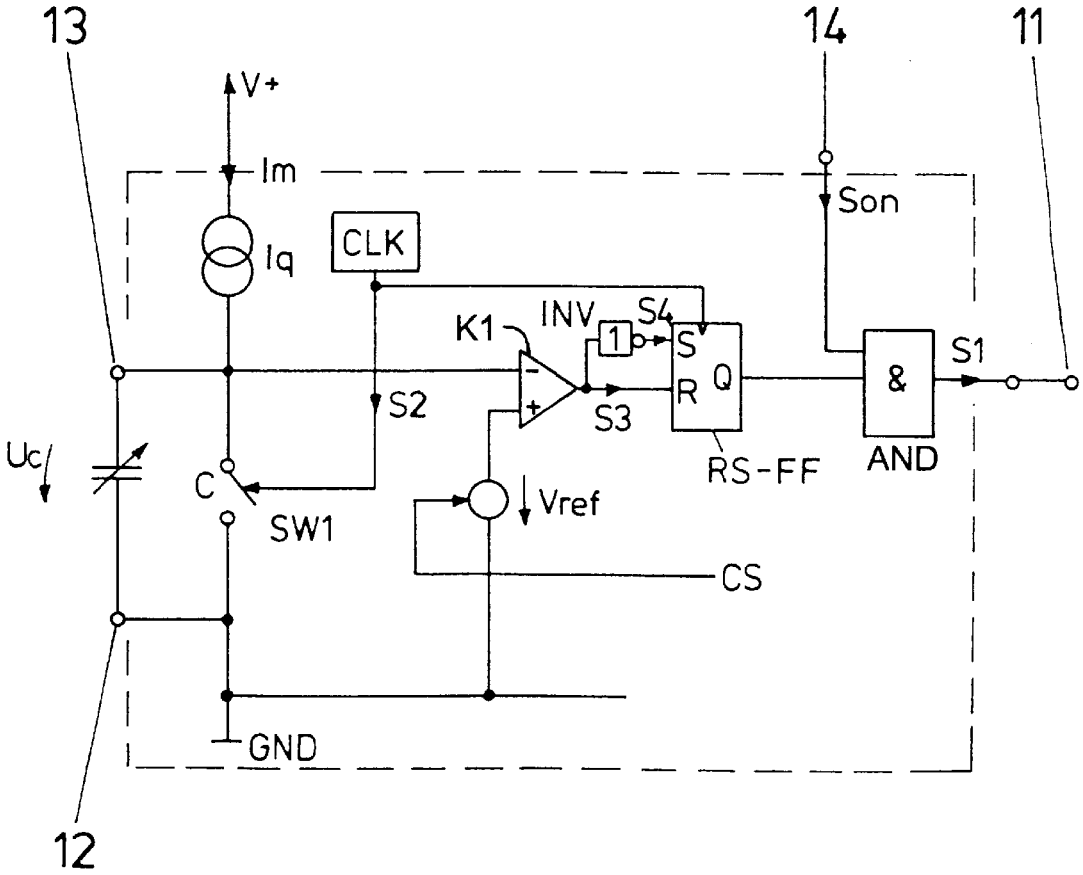
FIG. 6 is a circuit diagram of the drive circuit.

FIG. 6 shows a first exemplary embodiment of the drive circuit 10, which produces the drive signal S1 for the power transistor T1 as a function of the capacitance of the capacitor C between the connections 12, 13 and as a function of the switch-on signal Son at the connection 14.

The drive circuit 10 shown in FIG. 6 evaluates the capacitance value of the variable capacitor C and switches the power transistor T1 off via the drive signal S1 when the value of the capacitance of the capacitor C has risen above a predetermined value. When the capacitance value once again falls below a predetermined value, then the power transistor T1 is switched on once again. The clocked switching-on and off of the power transistor T1 in accordance with the drive signal S1 in this case continues only for as long as the switch-on signal Son, on the basis of which an acoustic signal is intended to be generated, is at an upper drive level.

In the exemplary embodiment shown in FIG. 6, the capacitance value of the capacitor C is determined by the capacitor C being charged with a constant electrical charge, and then being discharged, at regular time intervals. A voltage Uc across the capacitor C is dependent on the capacitance of the capacitor C and on the electrical charge stored in the capacitor c, with the voltage decreasing as the capacitance value rises, for the same amount of charge. In the circuit configuration shown in FIG. 6, a switch-off signal is produced for the switch when the capacitance at the end of a charging time of the capacitor C has risen above a predetermined value, that is to say when the voltage Uc across the capacitor C at the end of a charging time is less than a predetermined reference voltage Vref.

In order to produce this functionality, the drive circuit 10 has a current source Iq, which is connected in series with the capacitor C between a supply potential V+ and the reference potential GND. A first switch SW1 is connected in parallel with the capacitor C and is opened and closed in a clocked manner, as a function of a clock signal S2. The clock signal S2 is produced by a clock generator CLK. The drive circuit 10 furthermore has a comparator K1, whose negative input is connected to a node, which is common to the current source Iq and to the capacitor C, in order to detect the voltage Uc across the capacitor C, and to whose positive input a reference voltage Vref is applied, which is supplied from a reference voltage source. An output signal S3 is produced at an output of the comparator K1.

The comparator K1 is followed by an RS flip flop RS-FF, to whose reset input R the output of the comparator K1 is connected, and to whose set input S a signal S4 is applied, which is obtained, by inversion by an inverter INV, from the output signal S3 from the comparator K1. The clock signal S2 is supplied to a clock input of the RS flip flop, with the RS flip flop RS-FF configured such that it in each case evaluates or accepts the signals which are applied to the set and reset inputs S, R, on each rising flank of the clock signal S2.

The drive signal S1 is produced at the output of an AND gate AND, to one of whose inputs the Q-output of the RS flip flop is connected, and to whose other input the switch-on signal Son is applied.

Figure 7A:
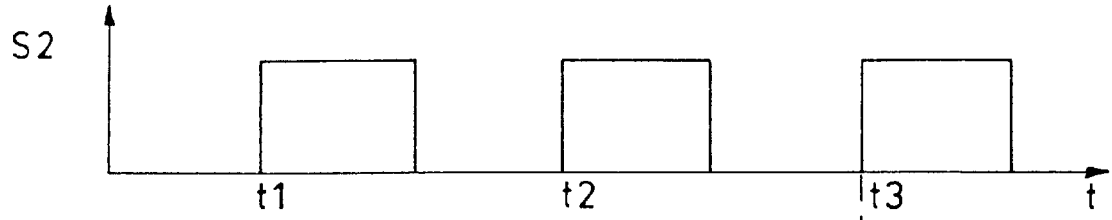
FIGS. 7*a*–7*d* are graphs of waveforms of selected signals in the circuit configuration shown in FIG. 6, plotted against time.
Figure 7B:
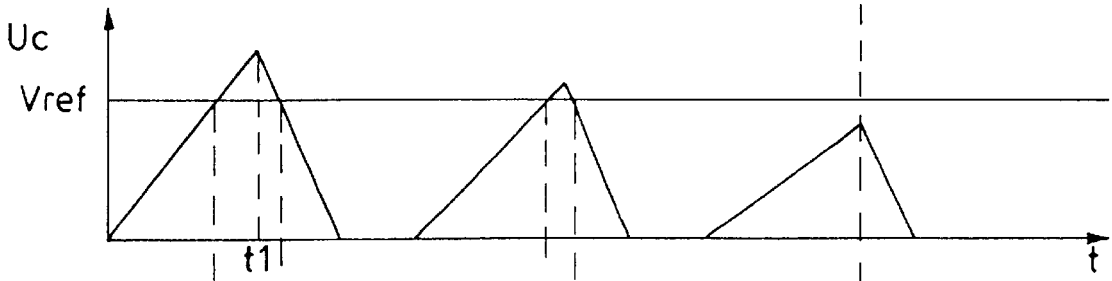
Figure 7C:
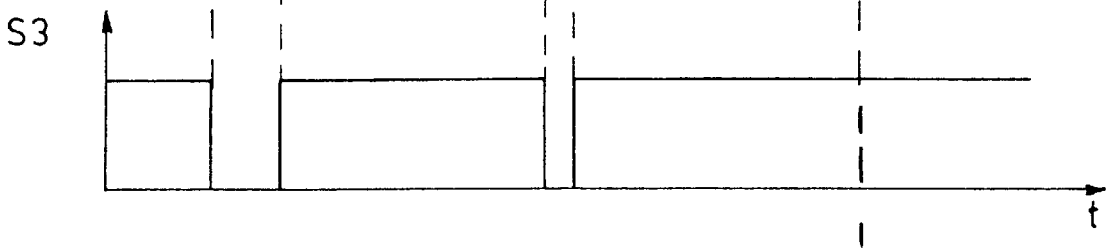
Figure 7D:
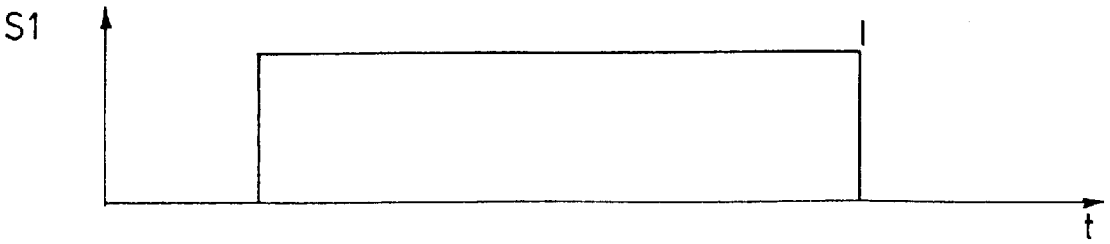

The method of operation of the drive circuit 10 shown in FIG. 6 will be explained in the following text with reference to FIGS. 7*a*–7*d*, which show a waveform of the clock signal S2 (FIG. 7*a*), a waveform of the voltage Uc across the capacitor C, and the reference voltage Vref (FIG. 7*b*), of the signal S3 produced at the output of the comparator K1 (FIG. 7*c*) and of the drive signal S1 (FIG. 7*d*).

The capacitor C is regularly charged and discharged via the current source Iq in time with the clock signal S2, with the capacitor C being charged when the clock signal S2 is at a lower drive level, and the switch SW1 thus being opened, and with the capacitor being discharged when the clock signal is at an upper drive level, and the switch S1 is thus closed. It is assumed that the clock frequency of the signal S2 is considerably higher than the natural frequency of the oscillating system containing the membrane 21 and the armature 23 as shown in FIGS. 1, 3, 4 and 5, so that the capacitance of the capacitor C can be assumed to be constant for the duration of one half-cycle of the clock signal S2. The voltage Uc across the capacitor C rises during the time in which a current Im is flowing into the capacitor C. When the clock signal S2 then assumes an upper drive level, then the switch SW1 is closed, and the capacitor C is discharged to the reference ground potential. The maximum value of the voltage Uc, shortly before the first switch SW1 switches on, is dependent on the charge that has flowed into the capacitor C and on the value of the capacitance of the capacitor C, with the voltage of the same charge decreasing as the value of the capacitance C rises. In other words, the higher the value of the capacitance C, the slower the rise of the voltage Uc across the capacitance C when the first switch SW1 is open. This is illustrated in FIG. 7*b*, in which it can be seen that the voltage Uc at a time t1 at the end of a first charging process is greater than at a time t2 at the end of a further charging process. The capacitance of the capacitor C thus increases over time, which results from the membrane 21 being deflected when current is flowing through the exciter coil 24.

A comparator K1 compares the capacitor voltage Uc with the reference voltage Vref. An output signal S3 from the comparator K1 assuming a lower signal level when the capacitor voltage Uc is greater than the reference voltage Vref. The comparator output signal S3 and an inverted output signal S4 are evaluated on each rising flank of the clock signal S2, that is to say when the capacitor voltage Uc is at its respective maximum value, and is received by the RS flip-flop RS-FF. The flip-flop is set by a signal S4 at a set input S when the capacitor voltage Uc is greater than the reference voltage Vref at the evaluation times, which are defined by the rising flanks of the clock signal S2. The output signal S1 in this case assumes an upper signal level for driving the switch T1 when the switch-on signal Son also assumes an upper signal level. In the exemplary embodiment, the drive signal S1 is at a low drive level before the evaluation time t1, and rises when the flip-flop is set at the time t1.

The flip-flop RS-FF remains set until an evaluation time occurs with a rising flank of the clock signal S2, in the example at the time t3, when the capacitor voltage is less than the reference voltage Vref. The flip-flop RS-FF is then reset, and the drive signal S1 assumes a lower drive level, in order to switch off the switch T1. The switch T1 is subsequently switched on again when the capacitance of the capacitor C has decreased sufficiently that the capacitor voltage Uc is greater than the reference voltage Vref at a later evaluation time.

Different reference voltages are preferably used, in a manner which is not illustrated, to set and reset the flip-flop, in order to switch off the switch when the capacitance of the capacitor C has exceeded a first threshold value, and in order to switch the switch on again only when the capacitance has fallen below a threshold value which is lower than the first threshold value. In circuitry terms, this can be achieved by a second comparator upstream of the set input S of the RS flip-flop RS-FF, whose positive input is supplied with the capacitor voltage and whose negative input is supplied with a second reference voltage, which is greater than the first reference voltage. The flip-flop RS-FF is only set to this voltage in order to switch the switch T1 on again as a function of the switch-on signal Son when the capacitor voltage is greater than the second reference voltage at the evaluation time.

The reference voltage Vref, as a function of which the switch is switched off, can preferably be adjusted by a signal CS, as is illustrated in FIG. 6. This makes it possible to adjust the volume of the acoustic signal that is generated, since the signal that is generated becomes louder the greater the deflection of the membrane 21 before the switch T1 is opened again. The signal CS is preferably dependent on the capacitance of the variable capacitor C in the undeflected state. To this end, the capacitance of the variable capacitor C is determined before the membrane 21 is deflected, at the start of each signal generation process. This may be done by charging the capacitor C with a specific electrical charge and determining the voltage that results from this across the capacitor. The voltage is a measure of the capacitance of the capacitor. The signal CS is then selected as a function of the determined voltage. The reference voltage Vref that is set by the signal CS is preferably a fixed, predetermined fraction of the initially determined voltage, in order to open the switch T1, when the capacitance of the capacitor C has increased by a specific percentage amount as a result of deflection of the membrane 21. Switching the switch on and off as a function of percentage changes in the capacitance of the variable capacitor C results in that absolute changes in the capacitance have no effect on the signal that is generated. The capacitance of the capacitor C may, for example, vary over the course of time due to aging processes or else due to slowly changing environmental influences, such as the air humidity. Secondly, the capacitors that are provided in the signal transmitter are subject to production-dependent fluctuations.

Figure 8:
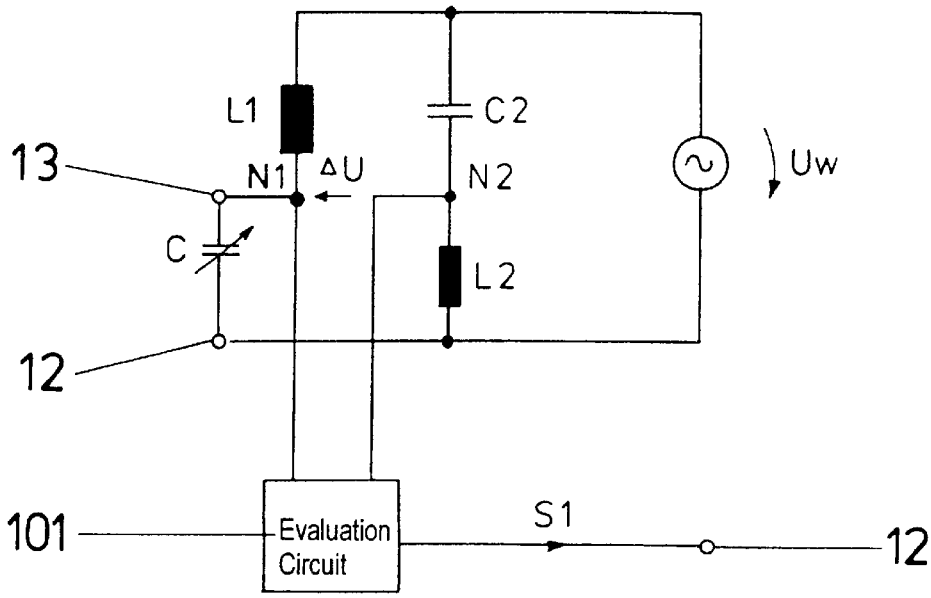
FIG. 8 is a circuit diagram of a second embodiment of the drive circuit.

FIG. 8 shows a further exemplary embodiment of the drive circuit 10 for providing the drive signal S1 for the power transistor T1. The drive circuit 10 has a bridge circuit with a first series resonant circuit L1, C and a second series resonant circuit C2, L2, which are connected in parallel and are connected to an AC voltage Uw. The first series tuned circuit contains the inductance L1 and the variable capacitor C in the capacitance sensor. The second series resonant circuit contains the capacitor C2 with a constant capacitance, and the constant inductance L2. The drive circuit 10 furthermore has an evaluation circuit 101, which is connected by a first connecting terminal to a node N1, which is common to the coil L1 and to the capacitor C, and which is connected via a second connecting terminal to a node N2, which is common to the capacitor C2 and to the inductance L2. A voltage DU is in this case zero when the two series resonant circuits are oscillating in phase. The evaluation circuit 101 evaluates the voltage difference and, in particular, the zero crossings of the difference signal, with the inductances L1, L2 and the capacitance C2 being selected such that, at a zero crossing of the difference signal DU, the variable capacitor C assumes a capacitance value at which the maximum deflection of the membrane 21 is reached, and the exciter winding 24 is intended is to be switched off. The drive signal S1 thus always assumes a lower drive level whenever the difference signal DU is zero.

Figure 9:
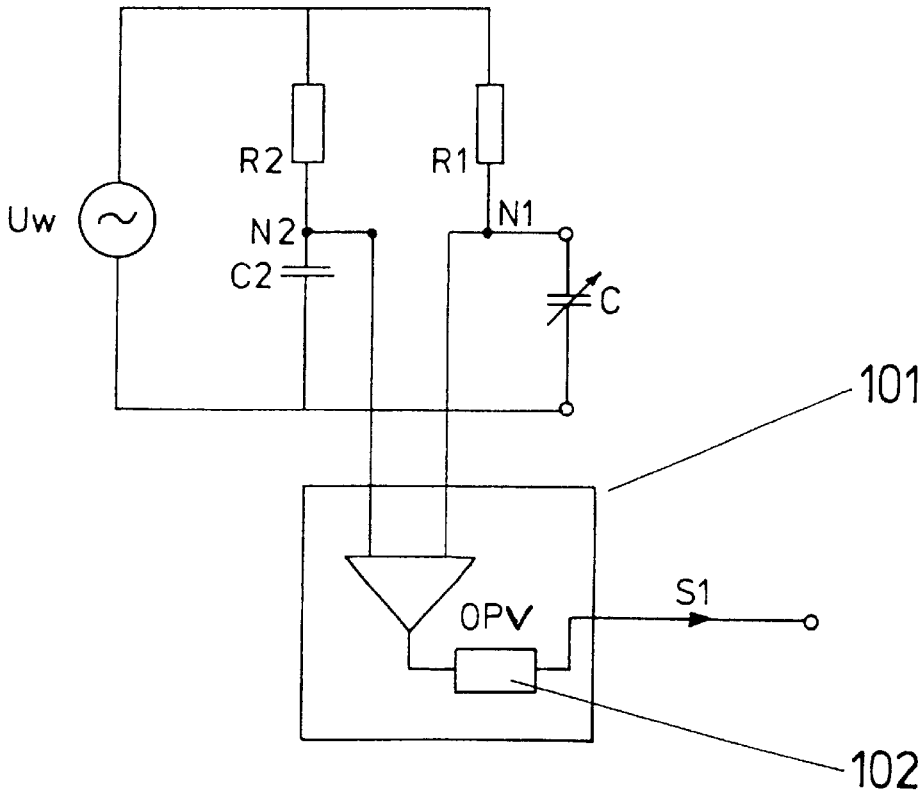
FIG. 9 is a circuit diagram of a third embodiment of the drive circuit.

The inductances L1, L2 can be replaced by resistors R1, R2 in the embodiment of the invention illustrated in FIG. 9, with, in this embodiment as well, an evaluation circuit which is connected to the common nodes N3, N4 of the capacitors C1, C2 and of the resistors R1, R2 evaluating the zero crossings of a voltage which is produced between these nodes N3, N4.

In addition to changes to the capacitance value due to deflection of the membrane 21, the variable capacitor C is subject to interference influences. The reference capacitor C2 according to the exemplary embodiment in FIGS. 8 and 9, and whose capacitance value is used for evaluating the capacitance value of the variable capacitor C, is preferably configured such that it is subject to the same interference influences as the variable capacitor C. One embodiment of the invention thus provides for the capacitor C2 likewise to be disposed in the signal transmitter 20, as is explained with reference to the exemplary embodiment of FIG. 3. In order to form the capacitor C2, a further electrode 29, which is preferably held by the insulating support 27, is disposed underneath the electrode 26, which forms one capacitor plate of the variable capacitor C. The electrode 26 and the electrode 29 form the capacitor plates of the capacitor C2, with the electrode 26 being common to the variable capacitor C and to the reference capacitor C2.

If the intention is to avoid a common capacitor plate, then a further embodiment, which is not illustrated in any more detail, provides for two electrodes, which are electrically insulated from one another, to be provided underneath the electrode 26, forming the capacitor plates of the reference capacitor C2. In this case, the housing 22 can also form one capacitor plate of the reference capacitor C2.

The distance between the capacitor plates of the reference capacitor C2 is constant, and is not influenced by the oscillating membrane 21. The capacitance of the reference capacitor is, however, subject to the same interference influences as the variable capacitor, which results in that it is possible to compensate for the influence of this interference on the variable capacitor C with little circuitry complexity.

In the exemplary embodiment shown in FIG. 9, an operational amplifier OPV in the evaluation circuit is connected to the two nodes N1, N2. If interference influences result in potential changes across the variable capacitor C, then the reference capacitor C2 that is disposed in the same housing is affected to the same extent, so that the output signal from the operational amplifier OPV is not influenced by the interference. A circuit configuration 102, which follows the operational amplifier OPV, produces the switching signal S1 as a function of the output signal from the operational amplifier OPV.

Figure 10:
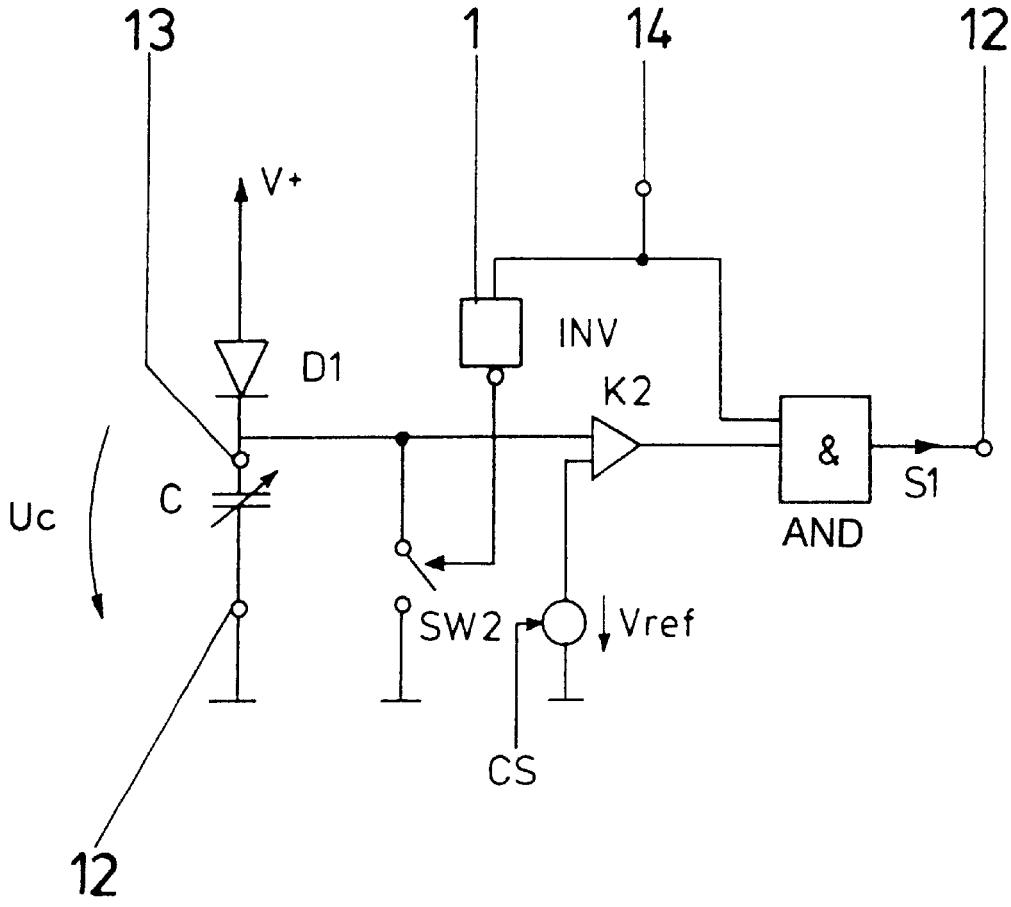
FIG. 10 is a circuit diagram of a fourth embodiment of the drive circuit.

FIG. 10 shows a further exemplary embodiment of the drive circuit 10 for producing the drive signal S1 for the power transistor T1.

The drive circuit 10 has a diode D1 which is connected in series with the capacitor C at the terminals 12, 13, with the series circuit containing the diode D1 and the capacitor C being connected between terminals for a supply potential V+ and for a reference ground potential GND. A second switch SW2 is connected in parallel with the capacitor C, and is opened or closed as a function of the switch-on signal Son. A comparator K2, whose positive input is connected to a node that is common to the diode D1 and to the capacitor C, compares the capacitor voltage Uc with a reference voltage Vref. One output of the comparator K2 is connected to an AND gate AND, and the switch-on signal Son is supplied to its other input.

The drive circuit 10, which is illustrated in FIG. 10, operates as follows. As long as the switch-on signal Son assumes a lower drive level, the drive signal S1 also assumes a lower drive level, and the power transistor T1 is switched off. The second switch SW2 is closed, as a result of which the capacitor C is discharged. When the switch-on signal Son subsequently assumes an upper drive level, then the capacitor C is very quickly charged to a voltage Uc0 which is chosen to be greater than the reference voltage Vref. As the deflection of the membrane increases when the exciter coil 24 is switched on, the distance between the capacitor plates decreases, as a result of which the value of the capacitance of the capacitor C rises, and as a result of which the voltage Uc falls since the amount of charge stored in the capacitor C is constant. When this voltage Uc falls below the value of the reference voltage Vref, then the drive signal S1 assumes a lower drive level, until the capacitor voltage Vc has fallen once again, when the membrane moves back in the direction of its original position.

In the drive circuits which are illustrated in FIGS. 6, 8 and 9, it is preferably a circuit configuration, which is not illustrated in any more detail in the figures, which determines the capacitance of the capacitor C at the start of each signal generation process, that is to say when the switch-on signal Son is rising to the upper drive level. The value of the capacitance of the capacitor C when the membrane is in the rest position can then be used to determine the switch-off threshold for the power transistor T1. The switch T1 is in this case preferably switched off when the capacitance has increased by a specific percentage value from the initial value when the membrane 21 is not deflected. In the case of the drive circuits 10 shown in FIGS. 6 and 10, the reference voltages Vref that are used to switch the power transistor off again can preferably be adjusted as a function of a capacitor signal CS which is dependent on the capacitance of the capacitor when the membrane is in the rest position. The reference voltage Vref is also used to adjust the volume of the signal that is generated. When the reference voltages Vref are increased, then the membrane 21 is deflected further until the power transistor is switched off again. This leads to the generated signal having a higher volume.

Each of the exemplary embodiments described so far has a capacitive deflection sensor whose capacitance is determined in order to determine the deflection of the membrane. In the examples, the capacitance of the capacitor C increases as the deflection increases, that is to say as the duration for which it is switched on increased. It is, of course, also possible to use sensors in which the capacitance of the capacitor decreases as the time for which it is switched on increases, in which case the evaluation circuits must then be modified as appropriate. In addition to the drive circuits described so far, any other circuit configurations for evaluating the capacitance of a capacitor can be used.

The evaluation circuit which evaluates the momentary capacity of the capacitive sensor and which controls the semiconductor circuit is preferably integrated in a chip. An especially space-saving realization of the acoustic signal generation device according to the invention thereby represents a signal generation device which is not described in detail in which this chip or an electrically conducting surface of this chip forms one of the two electrodes of the capacitor, preferably the fixed electrode which does not move. In the exemplary embodiments according to FIGS. 3 and 4 the fixed electrode 26 can thus be replaced by the chip, whereby the chip contains the control circuit 10 that is explained in the further figures.

In this exemplary embodiment, there is no power connection between the evaluation circuit and the fixed electrode, because the chip itself forms the electrode. In the embodiment it is provided to apply an electrode, for example made of polysilicon or metal, on the chip in order to improve the electrode characteristics of the chip.

In order to be able to generate the highest possible useful signal that is evaluated in the chip which, at the same time, forms one of the electrodes, the chip is disposed as closely as possible to the additionally required moving electrode which is formed by the membrane or a further electrode.

Besides the capacitive deflection sensors, any other deflection sensors can be used by the signal generation device according to the invention, dependent on which the power transistor is switched on and off in a clocked manner in order to cause the membrane to oscillate.

I claim:

1. An acoustic signal generator, comprising:

a membrane which can oscillate;

a deflection sensor for detecting any deflection of said membrane, said deflection sensor being a capacitive sensor having at least one capacitor;

an exciter configuration coupled to said membrane;

a power semiconductor switch having a load path connected to said exciter configuration and a drive connection; and a drive circuit having a first connection connected to said drive connection of said power semiconductor switch and generating a drive signal available at said drive connection, said drive circuit having a second connection connected to said deflection sensor.

2. The acoustic signal generator according to claim 1, wherein said drive circuit has a third connection for receiving a switch-on signal.

3. The acoustic signal generator according to claim 1, wherein said capacitor has a capacitor plate formed by said membrane.

4. The acoustic signal generator according to claim 3, including:

a housing surrounding said membrane; and an electrode insulated from said housing and forms a further capacitor plate of said capacitor of said capacitive sensor.

5. The acoustic signal generator according to claim 1, wherein said capacitor has an electrode coupled to said membrane, said electrode oscillates and forms a capacitor plate of said capacitor.

6. The acoustic signal generator according to claim 5, including a housing insulated from at least one of said membrane and said electrode and forms a further capacitor plate of said capacitor of said capacitive sensor.

7. The acoustic signal generator according to claim 1, wherein the drive signal is dependent on a capacitance of said capacitor of said capacitive sensor.

8. The acoustic signal generator according to claim 1, wherein said drive circuit has a current source, a drive circuit switch connected in parallel with said capacitor, and a comparator circuit connected to said capacitor for evaluating a capacitance of said capacitor, said current source connected in series with said capacitor, said comparator circuit comparing a voltage across said capacitor with a reference voltage, and, said comparator circuit having an output providing an output signal which is dependent on a comparison.

9. The acoustic signal generator according to claim 8, wherein the drive signal is dependent on the output signal at said output of said comparator circuit, and on the switch-on signal.

10. The acoustic signal generator according to claim 1, wherein said drive circuit has a bridge circuit with two series resonant circuits and an evaluation circuit, said two series resonant circuits including a first series resonant circuit containing said capacitor and a first tapping point, and a second series resonant circuit with a second tapping point, said evaluation circuit connected to and detecting a first potential at said first tapping point of said first series resonant circuit and a second potential at said second tapping point of said second series resonant circuit, said evaluation circuit producing the drive signal in dependence on a comparison of the first and second potentials.

11. The acoustic signal generator according to claim 1, wherein said drive circuit has a diode connected in series with said capacitor, a drive circuit switch connected in parallel with said capacitor, and a comparator configuration connected to said capacitor.

12. The acoustic signal generator according to claim 11, including a housing; and wherein said power semiconductor switch is a power transistor thermally coupled to said housing.

13. The acoustic signal generator according to claim 1, wherein said exciter configuration has an exciter winding and an armature coupled to said membrane, said exciter winding to be connected to a supply voltage and connected in series with said power semiconductor switch.

14. The acoustic signal generator according to claim 1, wherein said power semiconductor switch is a temperature-protected power transistor.

15. A method for generating an acoustic signal in dependence on a switch-on signal, which comprises the steps of:

providing a membrane which can oscillate, an exciter configuration coupled to the membrane, a drive circuit receiving the switch-on signal, a power semiconductor switch connected to the drive circuit, and a deflection sensor for detecting any deflection of the membrane; and clocking an opening and closing of the power semiconductor switch for as long as the switch-on signal is at a given value, with a closing duration, during which the power semiconductor switch is closed during a clock period, being dependent on the deflection sensor.

16. The method according to claim 15, which comprises forming the deflection sensor as a capacitive sensor having at least one variable capacitor, and in which the closing duration is dependent on a capacitance of the variable capacitor.

17. The method according to claim 16, which comprises determining a value of the capacitance of the variable capacitor when the power semiconductor switch is opened and after the switch-on signal has assumed the given value, and with the value of the capacitance of the variable capacitor being taken into account when determining the closing duration of the power semiconductor switch.

18. The method according to claim 17, which comprises opening the power semiconductor switch again after being closed, when the capacitance of the variable capacitor has changed by a predetermined percentage value.

* * * * *